US005676366A

United States Patent [19]

Polidoro

[11] Patent Number: 5,676,366

[45] Date of Patent: Oct. 14, 1997

[54] DEVICE FOR STACKING SHEETS

[75] Inventor: Roberto Polidoro, Geneva, Switzerland

[73] Assignee: Mars Incorporated, McLean, Va.

[21] Appl. No.: 505,227

[22] PCT Filed: Feb. 15, 1994

[86] PCT No.: PCT/IB94/00013

§ 371 Date: Aug. 15, 1995

§ 102(e) Date: Aug. 15, 1995

[87] PCT Pub. No.: WO94/19269

PCT Pub. Date: Sep. 1, 1994

[30] Foreign Application Priority Data

Feb. 16, 1993 [CH] Switzerland ..... 471193

[51] Int. Cl.[6] ..... B65H 43/00

[52] U.S. Cl. ..... 271/176; 271/180; 271/181

[58] Field of Search ..... 271/180, 181, 271/177, 176

[56] References Cited

U.S. PATENT DOCUMENTS

| | | | |
|---|---|---|---|
| 4,011,931 | 3/1977 | Wyckoff . | |
| 4,765,607 | 8/1988 | Zouzoulas . | |
| 4,784,274 | 11/1988 | Mori et al. . | |
| 5,067,701 | 11/1991 | Dekker . | |
| 5,419,423 | 5/1995 | Ishida et al. | 271/180 X |
| 5,421,443 | 6/1995 | Hatamachi et al. | 271/180 X |

FOREIGN PATENT DOCUMENTS

| | | |
|---|---|---|
| 0197656 | 10/1986 | European Pat. Off. . |
| 2453811 | 11/1980 | France . |

OTHER PUBLICATIONS

Research Disclosure No. 24 820, Dec. 1984.

Landis & Gyr brochure entitled "System de Traitment de Billets de Bang BSN 385/39/35", Sep. 1991.

*Primary Examiner*—David H. Bollinger
*Attorney, Agent, or Firm*—Fish & Richardson P.C.

[57] ABSTRACT

A device for stacking sheets comprises a drive (1) with a control device (29) and a pusher plate (6) which is arranged on a rod linkage (2), is displaceable perpendicular to a transport plane (8) and which pushes a sheet (5), which has been advanced in the transport plane (8) and aligned over a substantially rectangular entry opening (11) of a cassette (3), through the entry opening (11) into the cassette and onto a stack (4). The rod linkage comprises a control plane (13) and two pairs of arms (15, 16) forming double scissors that can be pivoted about an axle pin (19) by the drive (1). Pivoting of the double scissors moves the pusher plate (6) relative to the cassette (3). The control device (29) is arranged to limit the depth of penetration of the pusher plate (6) into the cassette (3) by reversing the direction of rotation of the drive (1) when the desired depth of penetration has been reached.

20 Claims, 2 Drawing Sheets

DEVICE FOR STACKING SHEETS

FIELD OF THE INVENTION

The invention relates to a device for stacking sheets, and, in particular, to stacking devices which suitable, for example, for the storage of banknotes in cassettes in service machines.

BACKGROUND OF THE INVENTION

A stacking device as shown in FIG. 1, is known from Research Disclosure No. 24, 820, December 1984. In this device a banknote 5 supplied by a transport system 7 is pushed onto a stack 4 of banknotes in a cassette 3 by means of a pusher plate 6 which moves through the transport plane 8. The stack 4 is supported on a sprung plate 9 and is pressed away from the entry opening 11 of the note cassette 4 by the pusher plate 6 until the banknote 5 has been conveyed beneath retaining lips 12 of the entry opening 11. As soon as the pusher plate 6 returns to its rest position, the banknotes on the stack 4 in the cassette 3 are pressed against the retaining lips 12 by the sprung plate 9. The position of the pusher pate 6 in the rest position is safeguarded merely by the moment of inertia of the drive motor 1.

The endless belts 7 are typically arranged in pairs in a plane parallel to the plane of the drawing in FIG. 1, are in contact over one section in the transport plane 8 and are designed to transport the sheets 5 clamped between the two endless belts 7. The number of pairs of endless belts and their spacing is predetermined by the width of the sheets 5 to be transported.

A pusher plate 6 has a rest position above the transport plane 8 and can be moved perpendicular to the transport plane 8, between two pairs of endless belts 7, towards the cassette 3 which is arranged below the transport plane 8. The pusher plate 6 can be of a shape such that its cross-section forms a substantially flat oval, the generators of the pressing plate 6 preferably lying parallel to the direction of transport of the sheets 5 in the transport plane 8. This shape of the pusher plate 6 prevents the pusher plate 6 from becoming caught on the endless belts 7.

The cassette 3 has a substantially rectangular entry opening 11 on the side facing the transport plane 8. At least two mutually opposing parallel edges of the entry opening 11 are constructed as retaining lips 12 the distance between which is slightly smaller than the corresponding dimension of the smallest permissible sheet 5. Arranged in the cassette 3 is a plate 9 which can be moved parallel no the transport plane 8 and which is pushed away from the floor of the cassette 3 towards the entry opening 11 by means of the compression spring 10. The sheets 5 form a stack 4 on the plate 9 which is pressed against the retaining lips 12 under the action of the compression spring 10.

By means of a crank shaft and the rod linkage 2 the drive 1 is connected to the pusher plate 6 which can be pushed from a rest position on the side of the transport plane 8 remote from the cassette 3 through that transport plane and into the cassette 3. The pusher plate 6 penetrates into the entry opening 11 and pushes the stack 4 and the plate 9 into the cassette 3 against the force of the compression spring 10 until the pusher plate 6 is fully extended.

When the pusher plate 6 is in the rest position, the sheet 5 accepted by a service machine (not shown) and intended for stacking is conveyed by the endless belts 7 of the transport system in the transport plane 8 above the cassette 3. The sheet 5 is stopped above the entry opening 11 and the pusher plate 6 is extended. The sheet 5 is thereby pulled out of the endless belts 7, the sheet 5 nestling against the surface of the pusher plate 6 and being pushed through the entry opening 11 past the retaining lips 12. There, the sheen 5 spreads flat again so that, when the pusher plate 6 is retracted, the sheet catches under the retaining lips 12 and remains in the cassette as the uppermost sheet 5 of the stack 4.

In FR-A-2 453 811 and U.S. Pat. No. 4,011,931, the pusher plate can be moved from the rest position into two predetermined positions. Advancement into the middle position conveys banknotes inserted individually into the machine into a temporary store. When all the notes have been inserted, the pusher plate advances beyond the middle position and deposits the contents of the temporary store in the cassette.

EP-A-0 197 656 describes a banknote stacker comprising a pusher plate which can be moved by means of a motor-driven cam disc, the pusher plate being pressed against the cam disc by means of a spring system so that, in its rest position, the pusher plate is reliably remote from the transport path of the banknotes. When stacking the notes, or sheets in general, the drive of this stacking device must be sufficient to overcome the spring force.

It would therefore be desirable to provide a stacking device for sheets of the kind mentioned in the precharacterising clause of claim 1, which device is an improvement over the state of the art and the control of which is simple and inexpensive.

SUMMARY OF THE INVENTION

According to a first aspect of the present invention there is provided a sheet stacking device for stacking sheets arriving at a predetermined position within a transport path, the device comprising a pusher, a housing, drive means for driving said pusher from a rest position to a position within said housing so as to move a sheet from said predetermined position in to said housing and a mechanical linkage for transmitting movement of said drive means to said pusher, characterised in that, when said pusher is in said rest position, said drive means is constrained to move substantially in a first direction and said mechanical linkage is arranged such that movement of said pusher from its rest position other than caused by said drive means would be transmitted by said mechanical linkage to said drive means in a second direction substantially transverse to said first direction and thereby substantially be inhibited.

According to a second aspect of the present invention there is provided a sheet stacking device for stacking sheets arriving at a predetermined position within a transport path, the device comprising a pusher, a housing and drive means for driving said pusher from a rest position to a position of maximum insertion within said housing so as to move a sheet from said predetermined position into said housing, characterised in that said device comprises control means for controlling the position of maximum insertion in dependence on a parameter of a sheet to be stacked by said device.

According to a third aspect of the present invention there is provided a sheet stacking device for stacking sheets of different dimensions in a housing and means for sensing when there is less than a predetermined amount of spare capacity in said housing and, in response thereto, for inhibiting the stacking of sheets having a dimension greater than a predetermined value while permitting the stacking of sheets having a dimension equal to or less than said predetermined value.

According to a fourth aspect of the present invention there is provided a sheet stacking device comprising a frame, drive means and a pusher which is arranged on a rod linkage to be displaceable in a direction perpendicular to a transport plane by said drive means, by means of which plate a sheet, which has been advanced in the transport plane and aligned with a substantially rectangular entry opening, may be pushed through the entry opening onto a stack in a cassette, characterised in that:

the rod linkage comprises a control plate portion and two pairs of arms, each pair comprising a control arm and a guide arm which are pivotally joined to each other cross-wise by means of an axle pin to form a double scissors arrangement, the axle pin serving to connect and space-apart the two pairs of arms as a common axle;

corresponding ends of the pairs of arms are connected to spacing means, the pusher plate being articulated at one end of each guide arm by a fastening pin, a sliding pin being displaceably mounted at the other end of each guide arm above the transport plane in a guideway arranged fixed in relation to the frame, a guide roller being displaceably mounted on a roller pin at one end of each control arm in a guide groove of the pusher plate; the guide groove being substantially parallel to the transport plane, the control arms being seated by their other end on a pivot pin which is arranged to rotate in the frame;

the control arms are rigidly connected to the control plate; and the double scissors are pivotable about the axis of the pivot pin by the drive means in order to move the pusher plate.

According to a fifth aspect of the present invention, there is provided a process for stacking sheets with a drive means controlled by a control device and a pusher which is arranged on a rod linkage and is displaceable by the drive means in a direction substantially perpendicular to a transport plane, by means of which pusher a sheet, which has been advanced in the transport plane and aligned over a substantially rectangular entry opening, is pushed through the entry opening onto a stack in a cassette, characterised in that:

the control device determines the necessary depth of penetration of the pusher plate into the cassette from the width of the sheet to be stacked;

the position of the pusher is scanned by detection means;

during stacking, the pusher is extended only as far as the determined necessary depth of penetration; and the direction of rotation of the drive means is reversed by the control device when the determined necessary depth of penetration has been reached.

Non-limiting embodiments of the invention are described in detail below with reference to the drawings.

DETAILED DESCRIPTION

Figure 1:
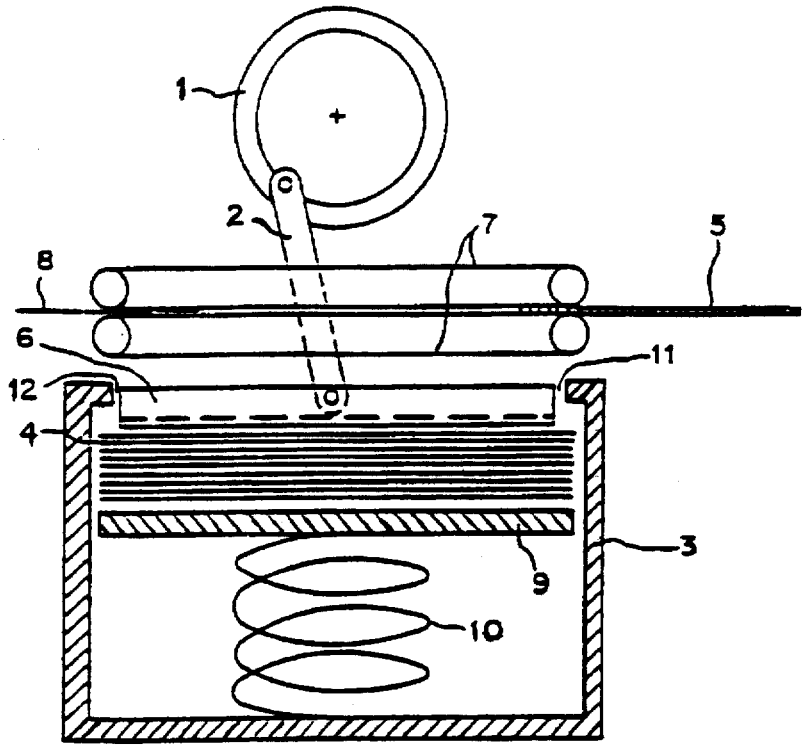
FIG. 1 shows a conventional stacking device.
Figure 2:
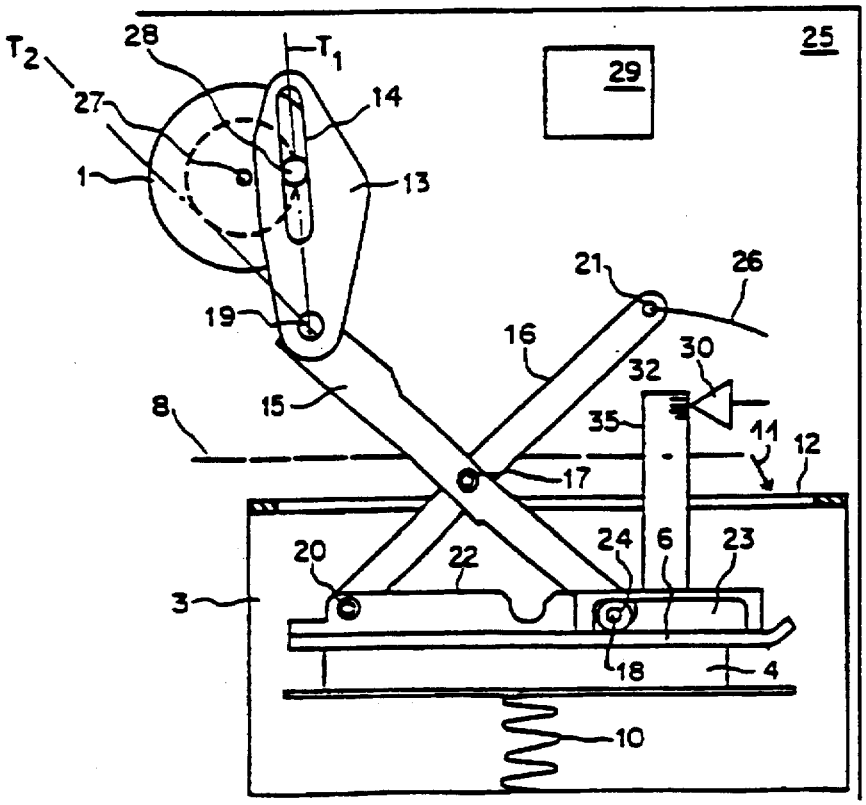
FIG. 2 shows a pusher plate fully extended.

Referring to FIG. 2, in which the same reference numerals as those in FIG. 1 refer to the same components, the rod linkage is in the form of a scissors arrangement which is fully extended by the drive 1, and comprises a control plate 13 with a control groove 14, two parallel control arms 15 and two parallel guide arms 16. One control arm 15 and one guide arm 16 in each case are joined to each other cross-wise approximately in their middle as a pair of arms so as to pivot about an axle pin 17 serving as a common axle. The two pairs of arms have the axle pin 17 as a common axle which holds the pairs of arms at a predetermined distance apart. Corresponding ends of the control arms 15 and the guide arms 16 are connected to each other at a predetermined distance apart by means of four pins 18, 19, 20 and 21 or equivalent means. The two pairs of arms form double scissors for extending the pressing plate 6 joined to them. This advantageously increases the lateral guiding force of the pusher plate 6.

Figure 3:
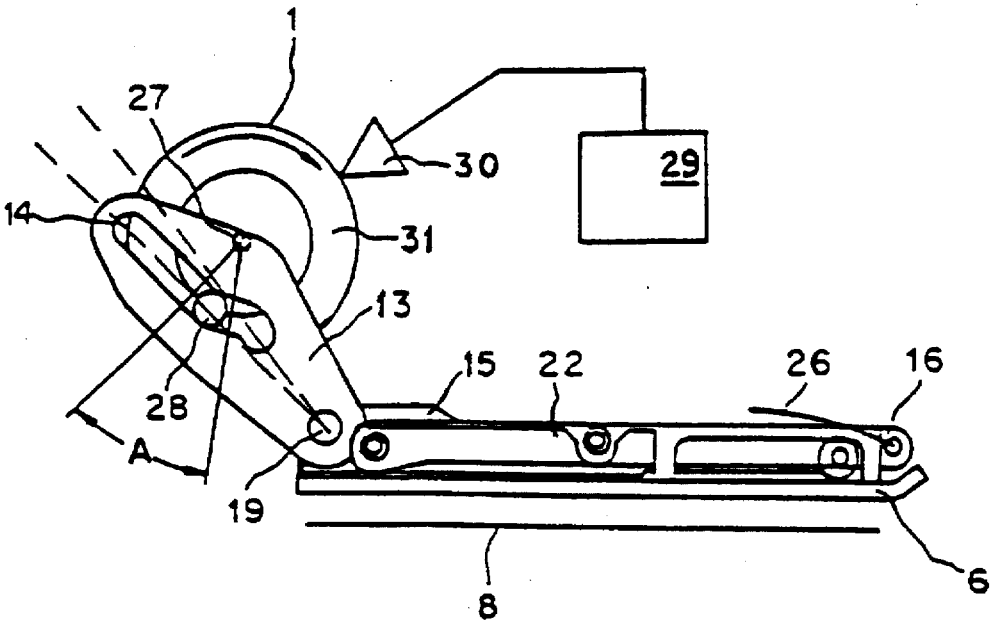
FIG. 3 shows the pusher plate in the rest position.

On its side remote from the cassette 3 the pusher plate 6 has two parallel carrier plates 22 which are of approximately the same length as the pusher plate 6 and are arranged perpendicular to the transport plane 8, the distance between the carrier plates 22 being so selected that the double scissors can be folded between the carrier plates 22, as shown in FIG. 3.

On the side remote from the drive 1 the carrier plates 22 each have a guide groove 23 extending parallel to the transport plane 8, which is engaged by guide rollers 24 which are arranged to rotate about the roller pin 18 at the end of the control arms 15 and can be moved in the guide grooves 23 as the double scissors are opened or closed.

The ends of the control arms 15 near the drive 1 and the control plate 13 are rigidly connected to each other by the pivot pin 19 in a non-rotatable manner so that the control plate 13 and the control arms 15 form a predetermined angle. The control plate 13 and the control arms 15 and the pivot pin 19 are pivotally mounted in a frame 25 of the stacking device. Every rotational movement of the control plate 13 about the pivot pin 19 is transmitted to the control arms 15 and opens or closes the double scissors.

The guide arms 16 are each connected at one end thereof to the rotatable fastening pin 20 for connecting the double scissors to the carrier plates 22 and, at their other ends, the sliding pin 21 which can be moved in an arcuate guidepath 26 fixed in relation to the frame 25.

Viewed from the pivot pin 19, the control groove 14 may extend in a straight line in the radial direction. The drive 1 which is arranged in a fixed position in the frame 25 rotates a finger 28 in a circle about the drive shaft 27 by means of a crank shaft which is seated on its drive shaft 27. The finger 28 projects into the control groove 14 and converts the circular movement of the finger 28 into a pivoting of the control arms 15 about the pivot pin 19, which causes the double scissors to open and close. The two extreme positions of the control plate 13 are predetermined by the position of the two tangents $T_1$ and $T_2$, shown by dashed lines, which are laid from the axis of the pivot pin 19 against the circle of rotation of the finger 28. The movement of the double scissors causes linear displacement of the pusher plate 6 perpendicular to the transport plane 8, the guided movements of the guide rollers 24 in the guide groove 23 and of the sliding pin in the guideway 26 keeping the pusher plate 6 parallel to the transport plane 8.

In FIG. 2, the finger 28 has arrived at the location of the first tangent $T_1$ in its rotation, while the pusher plate 6 has reached the bottom dead centre of its movement and has thus passed through the entry opening 11 and into the cassette 3 to its furthest extent. It presses the stack 4 away from the retaining lips 12 against the force of the spring 10.

When the drive 1 continues to turn the finger 28 out of the position shown in one of the two directions, the control plate 13 is turned about the pivot pin 19 in the anti-clockwise direction and the double scissors close and retract the pusher plate 6 from the cassette 3 into a rest position above the transport plane 8. The finger 28 is then at the location of the second tangent $T_2$.

As soon as the pusher plate 6 is in the rest position, a control device 29, which, in addition to other control functions, controls the stacking process, is able to convey the next sheet 5 in the transport plane 8 to the stacking device and align it over the entry opening 11. The pusher plate 6 is preferably bent upward towards the direction of the approaching sheets 5 in order to avoid fouling of the sheets 5. The drive 1 rotates in the clockwise direction until the pusher plate 6 has been completely extended into the cassette 3. The sheet 5 is thereby pushed out of the transport plane 8 and deposited on the stack 4. The drive 1 continues to run until the pusher plate 6 has reached the rest position again and the drive 1 is switched off.

FIG. 3 shows the rest position of the pusher plate 6, in which the control arms 15 and the guide arms 16 of the double scissors are folded together on the pusher plate 6 between the carrier plates 22 and parallel to the transport plane 8. The movement of the guide rollers 24 in the guide groove 23 and of the sliding pin 21 in the guideway 26 when the pusher plate 6 is changed from the fully extended state to the rest position will be clear from a comparison between the two FIGS. 2 and 3.

This stacking device for sheets 5 has the advantage that the dead weight of the pusher plate 6 cannot cause the drive 1 to rotate, which would result in an uncontrolled lowering of the pusher plate 6, since the force exerted by the control groove 14 on the finger 28 in the resting state acts radially in relation to the drive shaft 27.

The control groove 14 may be divided into three sections, two outer sections of which are oriented radially in relation to the pivot pin 19 and extend in a straight line, as shown in FIG. 3. Viewed from the pivot pin 19, the control groove 14 curves in the middle section first to the left and then, in a region A, to the right in order to lead as an S-shaped groove into the second outer section. The two radial directions of the outer sections include an angle which is predetermined by the S-shaped groove. The S-shaped control groove 14 has the advantage that, by shortening the arc of the circle of rotation of the finger 28 from the first tangent $T_1$ to the second tangent $T_2$ (see FIG. 2), the region A determining the upper rest position of the pusher plate 6 is extended beyond the exact location of the second tangent $T_2$. A sensor 30 that scans the position of the finger 28 can therefore be inexpensive, since a low resolution of the rotational movement of the finger 28 about the drive shaft 27 is sufficient to detect the presence of the finger 28 in the region A. The sensor 30 is connected to the control device 29 which, in addition to other control functions, controls the stacking operation.

By way of example, the control groove 14 is, in the region A, an arc of a circle curving to the right which leads into the second, elongate outer section of the control groove 14. In the rest position of the pusher plate 6, the finger 28 is situated in the region A of the control groove 14, which is in the form of an arc of a circle concentric with the drive shaft 27. As when the finger 28 moves within the region A, the distance of the control groove 14 from the drive shaft 27 is constant and the control plate 13 does not rotate about the pivot pin 19, so that the pusher plate 6 remains in its rest position. As soon as the finger 28 is outside the region A, the control plate 13 follows the finger 28 and rotates about the pivot pin 19 in the predetermined angular region. By providing the region A as an arc of a circle in the control groove 14 this has the additional advantage that the rest position of the pusher plate 6 is maintained even in the event of extreme external vibration.

When the drive 1 turns the finger 28 clockwise out of the rest position shown in FIG. 3, the double scissors together with the pusher plate 6 are extended until the necessary penetration depth in the cassette 3 for placing the sheet 5 on the stack 4 has been reached.

By reversing the direction of rotation of the drive 1 by the control device 29, the pusher plate 6 can be returned to its rest position before it has reached the bottom dead centre of the movement. The stack 4 can advantageously be stacked higher before the stacking process is hindered by the plate 9 resting on the floor of the cassette 3. The control device may be equipped to process information on a dimension (e.g. width) of the sheet 5 to be stacked, which information is supplied, for example, by a testing device (not shown) which senses the dimension directly or determines the dimension from a look-up table stored in the control device 29 in dependence on the sensed denomination of the banknote, or can be set at a fixed value at the control device 29. The control device 29 can then advantageously determine the necessary depth of penetration of the pusher plate 6 into the cassette 3 from the width of the sheets 5 and reverse the direction of rotation of the drive 1 when the pusher plate 6 has reached the determined necessary depth of penetration into the cassette 3. Since for narrow sheets 5 a smaller depth of penetration is sufficient for stacking than is required for wide sheets 5, the volume of the cassette 3 can be utilised more efficiently.

The reversal of the direction of rotation of the drive 1, by enabling a smaller depth of penetration of the pusher plate 6 when stacking smaller sheets, provides the advantage of reduced power consumption, since less power is required by the drive 1 to overcome the force of the compression spring 10, when the pusher plate 6 penetrates the cassette 3 by a smaller distance.

For example, in the case of service machines, the sheets 5 to be stacked are banknotes of different widths which are usually aligned at one side edge for checking and transport, so that the necessary depth of penetration during the stacking is different for different banknotes. The spare capacity within the cassette 3 can be determined either by a count of the number of banknotes already stacked in the cassette 3 or by providing one or more sensors within the cassette 3 to generate signals representing the spare capacity, these signals being supplied to the control device 29. When the cassette 3 is almost full, the control device 29 permits only small banknotes to be accepted, with the result that at least a reduced operation of the service machine is possible until the cassette 3 is changed. This method can also be used to operate the stacking devices described in the introduction if sheets 5 of different widths are to be stacked.

A plurality of stacking devices could be arranged within a single system, wherein each stacking device is arranged to accept banknotes of a different respective type, such as denomination. In this case, the necessary depth of penetration of each pusher plate can advantageously be pre-set in accordance with the banknote type which it is arranged to accept, although the depth could alternatively be determined for each banknote being stacked, e.g. by direct sensing of the dimension or by a look-up table as described above.

As an alternative arrangement, it would be possible for the direction of rotation of the drive 1 not to be reversed during the stacking operation until a predetermined number or volume of banknotes is present in the cassette 3. In this case, the maximum possible penetration of the pusher plate 6 is arranged to be that necessary to stack banknotes having the largest dimension which the stacking device is arranged to accept. Once the predetermined number or volume of banknotes has been stacked, the device is arranged to stack only those banknotes having a dimension less than a predetermined value, and the depth of penetration of the pusher plate 6 is reduced in each subsequent cycle of operation by reversal of the direction of rotation of the drive 1.

A banknote validating system incorporating such a banknote stacking device could be arranged to inhibit validation of banknotes having a dimension greater than or equal to the predetermined value, while permitting validation of banknotes having a dimension less than this value.

For controlling the drive 1 by means of the control device 29 there is arranged on the drive shaft 27 a shaft encoder which comprises a sensor 30 arranged in a fixed position in the frame 25 (FIG. 2) and a disc encoder 31 seated on the drive shaft 27. The sensor 30 scans the disc encoder 31 so that the control device 29 recognises the depth of penetration of the pusher plate 6 into the cassette 3.

Figure 4:
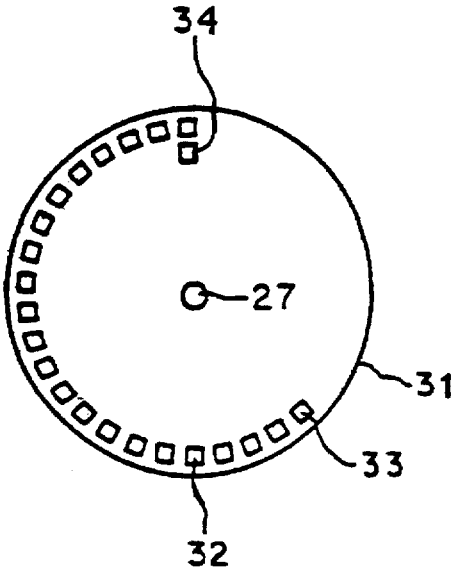
FIG. 4 shows a disc encoder.

In FIG. 4, the disc encoder 31 seated on the drive shaft 27 has markings 32, 33 at predetermined intervals along an arc of a circle which can be scanned by the sensor 30 (FIG. 3) as the drive shaft 27 rotates from the rest position to the dead centre of the movement of the pusher plate 6 in the cassette 3. The last marking 33 in the anti-clockwise direction signals the above-mentioned dead centre. By counting the markings 32, 33 the control device 29 is able to establish how deeply the pusher plate 6 has penetrated into the cassette 3. A start mark 34 is disposed on the same radial line as the first marking 32, for example closer to the centre of the disc encoder 31, and is clearly recognisable by the sensor 30.

For reasons of cost and because the resolution of the shaft encoder does not need to be high, the sensor 30 advantageously comprises two parallel light barriers which are able to scan holes in the disc encoder 31 as markings 32, 33, 34, the one light barrier serving to detect the markings 32, 33 to establish the position of the pressing plate 6 and the other to detect the start mark 34.

Other shaft encoders having a higher resolution capacity may alternatively be used.

As shown in FIG. 2, the position of the pusher plate 6 can also be monitored by means of a travel indicator instead of by the shaft encoder, the travel indicator being able to detect a relative movement between the frame 25 and the pusher plate 6 or the double scissors. Thus a ruler 35 having the corresponding markings 32, 33 and 34, which are read by the sensor 30, is arranged on the pusher plate 6 or on the double scissors. The ruler 35 fulfils the same function as the disc encoder 31.

I claim:

1. A sheet stacking device for stacking sheets arriving at a predetermined position within a transport path, the device comprising a pusher, a housing, drive means for driving the pusher from a rest position to a position within the housing so as to move a sheet from the predetermined position into the housing and a mechanical linkage for transmitting movement of the drive means to the pusher, wherein the mechanical linkage comprises a control arm which acts on the pusher, and wherein the drive means comprises a projection mounted for movement within a guide slot connected to the control arm such that a first component of the movement of the projection is accommodated within the guide slot and a second component of the movement of the projection causes the control arm to move thereby to execute movement of the pusher, and wherein the guide slot is shaped such that, when the pusher is in the rest position, the drive means is able to execute a limited degree of movement without transmitting movement to the pusher, thereby substantially to prevent vibration of the drive means from being transmitted to the pusher when in the rest position.

2. A sheet stacking device as claimed in claim 1, wherein the projection is mounted for substantially rotational movement about a drive axis.

3. A sheet stacking device as claimed in claim 2, wherein the guide slot comprises an arcuate region having a curvature centered about the drive axis within which region the projection is located when the pusher plate is in its rest position.

4. A sheet stacking device as claimed in claim 3, wherein the guide slot comprises in sequence a first substantially straight region and the arcuate region.

5. A sheet stacking device as claimed in claim 1, wherein the mechanical linkage comprises a scissors arrangement of the control arm and a guide arm, a first end of the control arm and a first end of the guide arm being connected to the pusher.

6. A sheet stacking device as claimed in claim 1, wherein the control arm pivots about a pivot axis, the guide slot generally extending in a substantially straight line, the geometrical projection of which, beyond the guide slot, passes through the pivot axis.

7. A sheet stacking device as claimed in claim 1, wherein the guide slot comprises three sections, the two outer sections of which extend in two radial directions from the pivot axis and include an angle, and the middle section connecting the two outer sections is curved in an "S" shape.

8. A sheet stacking device as claimed in claim 1, further comprising control means for controlling the position of maximum insertion of said pusher within said housing in dependence on a parameter of a sheet to be stacked by said device.

9. A sheet stacking device for stacking sheets arriving at a predetermined position within a transport path, the device comprising a pusher, a housing and drive means for driving said pusher from a rest position to a position of maximum insertion within said housing so as to move a sheet from said predetermined position into said housing, wherein said device comprises control means for controlling the position of maximum insertion in dependence on a parameter of a sheet to be stacked by said device.

10. A sheet stacking device as claimed in claim 9, wherein the pusher is connected to the drive means by cam means shaped such that the drive means is able to execute a limited degree of movement without transmitting any movement to the pusher when in the rest position, thereby substantially to prevent vibration of the drive means from being transmitted to the pusher when in the rest position.

11. A sheet stacking device as claimed in either claim 1 or 4, wherein said control means comprises sensor means for sensing the position of said pusher.

12. A sheet stacking device as claimed in claim 11, wherein said drive means comprises a drive shaft and said sensor means comprises an encoder attached to said drive shaft.

13. A sheet stacking device as claimed in 11, wherein said sensor means comprises an encoder attached to said pusher.

14. A sheet stacking device as claimed in either claim 1 or 9, wherein the control means comprises means for reversing the operation of the drive means when the pusher reaches the desired position of maximum insertion.

15. A sheet handling system comprising a sheet stacking device for stacking sheets of different dimensions in a housing, means for sensing when there is less than a predetermined amount of spare capacity in the housing and means for inhibiting the stacking of sheets having a dimension greater than a predetermined value when the sensing means senses a shortage in capacity.

16. A sheet stacking device comprising a frame, drive means and a pusher which is arranged on a rod linkage to be displaceable in a direction perpendicular to a transport plane by the drive means, whereby a sheet, which has been advanced in the transport plane and aligned with a substantially rectangular entry opening, may be pushed through the entry opening onto a stack in a cassette, wherein:

the rod linkage comprises a control plate portion and two pairs of arms, each pair comprising a control arm and a guide arm which are pivotally joined to each other cross-wise by means of an axle pin to form a double scissors arrangement, the axle pin serving to connect and space-apart the two pairs of arms as a common axle;

the pusher is articulated at one end of each guide arm by a fastening pin, a sliding pin being displaceably mounted at the other end of each guide arm above the transport plane in a guideway arranged fixed in relation to the frame, a guide roller being displaceably mounted on a roller pin at one end of each control arm in a guide groove of the pusher, the guide groove being substantially parallel to the transport plane, the control arms being seated by their other end on a pivot pin which is arranged to rotate in the frame;

the control arms are rigidly connected to the control plate; and the double scissors are pivotable about the axis of the pivot pin by the drive means in order to move the pusher.

17. A sheet stacking device according to claim 1, 9 or 16, wherein the pusher comprises a pusher plate.

18. A sheet handling system comprising a sheet stacking device for stacking sheets arriving at a predetermined position within a transport path, the sheet stacking device comprising:

a pusher;

a housing;

drive means for driving the pusher from a rest position to a position within the housing so as to move a sheet from the predetermined position into the housing;

a mechanical linkage for transmitting movement of the drive means to said pusher, wherein the mechanical linkage comprises a control arm which acts on the pusher, and wherein the drive means comprises a projection mounted for movement within a guide slot connected to the control arm such that a first component of the movement of the projection is accommodated within the guide slot and a second component of the movement of the projection causes the control arm to move thereby to execute movement of the pusher, and wherein the guide slot is shaped such that when the pusher is in the rest position the drive means is able to execute a limited degree of movement without transmitting movement to the pusher, thereby substantially preventing vibration of the drive means from being transmitted to the pusher when in said rest position; and means for sensing when there is less than a predetermined amount of spare capacity in said housing and, in response thereto, for inhibiting the stacking of sheets having a dimension greater than a predetermined value while permitting the stacking of sheets having a dimension equal to or less than said predetermined value.

19. A sheet stacking device for stacking sheets arriving at a predetermined position within a transport path, the device comprising:

a pusher;

a housing;

drive means for driving said pusher from a rest position to a position of maximum insertion within said housing so as to move a sheet from said predetermined position into said housing;

control means for controlling the position of maximum insertion in dependence on a parameter of a sheet to be stacked by said device; and means for sensing when there is less than a predetermined amount of spare capacity in said housing and, in response thereto, for inhibiting the stacking of sheets having a dimension greater than a predetermined value while permitting the stacking of sheets having a dimension equal to or less than said predetermined value.

20. A process for stacking sheets with a driver means controlled by a control device and a pusher which is arranged on a rod linkage and is displaceable by the drive means in a direction substantially perpendicular to a transport plane, by means of which a sheet, which has been advanced in the transport plane and aligned over a substantially rectangular entry opening, is pushed through the entry opening onto a stack in a cassette, the process comprising the steps of:

determining the necessary depth of penetration of the pusher plate into the cassette from the width of the sheet to be stacked;

scanning the position of the pusher;

extending the pusher during stacking only as far as the necessary depth of penetration; and reversing the direction of rotation of the drive means when the necessary depth of penetration has been reached.

* * * * *

UNITED STATES PATENT AND TRADEMARK OFFICE

CERTIFICATE OF CORRECTION

PATENT NO. : 5,676,366

DATED : October 14, 1997

INVENTOR(S) : Roberto Polidoro

It is certified that error appears in the above-identified patent and that said Letters Patent is hereby corrected as shown below:

Col. 1, line 5, after "which", insert --are--.

Col. 2, line 4, cancel "sheen" and insert --sheet--.

Col. 8, line 58 (claim 11), cancel "4" and insert --9--.

Signed and Sealed this

Eighth Day of September, 1998

*Attest:*

Bruce Lehman

BRUCE LEHMAN

*Attesting Officer*

*Commissioner of Patents and Trademarks*